US009964296B2

(12) United States Patent
Hikmet et al.

(10) Patent No.: US 9,964,296 B2
(45) Date of Patent: May 8, 2018

(54) LIGHTING DEVICE WITH A THERMALLY CONDUCTIVE FLUID

(71) Applicant: PHILIPS LIGHTING HOLDING B.V., Eindhoven (NL)

(72) Inventors: Rifat Ata Mustafa Hikmet, Eindhoven (NL); Coen Theodorus Hubertus Fransiscus Liedenbaum, Oss (NL); Ties Van Bommel, Horst (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 3 days.

(21) Appl. No.: 15/001,689

(22) Filed: Jan. 20, 2016

(65) Prior Publication Data

US 2016/0238228 A1 Aug. 18, 2016

(30) Foreign Application Priority Data

Feb. 12, 2015 (EP) ..... 15154787

(51) Int. Cl.

| | |
|---|---|
| ***F21V 29/00*** | (2015.01) |
| ***F21V 29/70*** | (2015.01) |
| ***F21V 29/83*** | (2015.01) |
| ***F21K 9/23*** | (2016.01) |
| ***F21K 9/27*** | (2016.01) |
| ***F21V 29/503*** | (2015.01) |
| ***F21V 31/00*** | (2006.01) |

(Continued)

(52) U.S. Cl.

CPC ..... *F21V 29/70* (2015.01); *F21K 9/23* (2016.08); *F21K 9/27* (2016.08); *F21K 9/64* (2016.08); *F21V 29/503* (2015.01); *F21V 29/83* (2015.01); *F21V 31/00* (2013.01); *F21V 31/04* (2013.01); *F21Y 2101/00* (2013.01); *F21Y 2115/10* (2016.08)

(58) Field of Classification Search

CPC . F21K 9/56; F21V 29/70; F21V 29/83; F21V 31/04; H01J 61/34

USPC ..... 362/84; 313/17, 36, 44–47

See application file for complete search history.

(56) References Cited

U.S. PATENT DOCUMENTS 8,992,051 B2 * 3/2015 Yang ..... F21V 3/02 362/294
2010/0314985 A1 * 12/2010 Premysler ..... F21V 29/402 313/46

(Continued)

FOREIGN PATENT DOCUMENTS

CN 202392488 U 8/2012
CN 202834823 U 3/2013

(Continued)

*Primary Examiner* — Elmito Breval
*Assistant Examiner* — Michael Chiang
(74) *Attorney, Agent, or Firm* — Akarsh P. Belagodu

(57) ABSTRACT

A lighting device (100) is disclosed, comprising a first closed or delimited space (120) which is fluidly sealed and includes a thermally conductive fluid therein, and at least one delimited second space (150) which is partly enclosed by the first space (120) and is fluidly connected to the exterior of the lighting device (100). The second space (150) comprises a thermally conductive interface (160) to the first space (120). The thermally conductive interface (160) is coupled to at least one light-emitting element (170) arranged within the second space (150) and configured to emit light such that at least a portion of the light is emitted into the first space (120).

17 Claims, 7 Drawing Sheets

(51) Int. Cl.

| | |
|---|---|
| ***F21V 31/04*** | (2006.01) |
| ***F21K 9/64*** | (2016.01) |
| *F21Y 115/10* | (2016.01) |
| *F21Y 101/00* | (2016.01) |

(56) References Cited

U.S. PATENT DOCUMENTS

| | | | | |
|---|---|---|---|---|
| 2011/0074296 | A1* | 3/2011 | Shen | F21V 3/00 315/112 |
| 2011/0095686 | A1 | 4/2011 | Falicoff et al. | |
| 2012/0061699 | A1 | 3/2012 | Ansems et al. | |
| 2013/0093307 | A1* | 4/2013 | Cheng | F21V 29/004 313/36 |
| 2013/0207533 | A1* | 8/2013 | de Koning | F21K 9/00 313/46 |
| 2013/0258671 | A1 | 10/2013 | Baumann et al. | |
| 2013/0271989 | A1* | 10/2013 | Hussell | F21V 29/004 362/249.02 |
| 2014/0185269 | A1* | 7/2014 | Li | F21K 9/56 362/84 |
| 2014/0232252 | A1 | 8/2014 | Li | |
| 2014/0375202 | A1 | 12/2014 | Yang | |
| 2016/0377278 | A1* | 12/2016 | Kato | F21K 9/232 362/363 |

FOREIGN PATENT DOCUMENTS

| | | | |
|---|---|---|---|
| CN | 202834825 | U | 3/2013 |
| CN | 103062662 | A | 4/2013 |
| CN | 203703668 | U | 7/2014 |
| FR | 3000782 | A1 | 7/2014 |
| KR | 101211402 | B1 | 12/2012 |

* cited by examiner

LIGHTING DEVICE WITH A THERMALLY CONDUCTIVE FLUID

TECHNICAL FIELD

The present invention generally relates to the field of lighting equipment and devices. Specifically, the present invention relates to a lighting device comprising a first, at least in part light-transmissive, surface structure, at least in part delimiting a fluidly sealed, closed space which includes a thermally conductive fluid therein.

BACKGROUND

The use of light-emitting diodes (LEDs) for illumination purposes continues to attract attention. Compared to incandescent lamps, fluorescent lamps, neon tube lamps, etc., LEDs provide numerous advantages such as a longer operational life, reduced power consumption, an increased efficiency related to the ratio between light energy and heat energy, etc. Solid state based light sources such as LED based light sources may have different optical characteristics compared to incandescent light sources. In particular, solid state based light sources may provide a more directed light distribution and a higher (i.e. cooler) color temperature compared to incandescent light sources. Therefore, efforts have been made in order to make solid state based lighting devices mimic or resemble traditional incandescent lighting devices, e.g. with respect to light distribution and/or color temperature. In bulb lighting devices based on LEDs, commonly referred to as "retrofit lamps" since these LED lamps are often designed to have the appearance of a traditional incandescent light bulb and to be mounted in conventional sockets, etc., the light emitting filament wire is replaced with one or more LEDs. The atmosphere within the bulb is generally air. However, cooling of the LEDs may pose a problem in LED based retrofit lamps. Overheating of LEDs can lead to reduced lifetime, decreased light output or failure of the LEDs.

SUMMARY

In order to facilitate or increase degree of cooling of LEDs in LED light bulbs, the LED light bulbs can be filled with a heat conductive fluid or gas or a mixture of several heat conductive fluids or gases such that the LEDs in the LED light bulb are arranged in an atmosphere of heat conductive fluid or gas, e.g. a gas including helium or hydrogen. By means of the atmosphere of heat conductive fluid or gas within which the LEDs are arranged, heat generated by the LEDs when in use may be transferred away from the LEDs for example to the dome of the LED light bulb where it can be transferred or dissipated to the surroundings of the LED light bulb. The heat transport away from the LEDs is much more efficient compared to if the LED light bulb would be filled with air. However, LEDs which are situated in an atmosphere of heat conductive fluid or gas such as helium gas may age relatively rapidly, whereby light emission functionality and/or capacity of the LEDs may deteriorate relatively quickly, which for example may result in a relatively rapid decrease in brightness and/or intensity of the light output by the LEDs.

In view of the above, a concern of the present invention is to provide a lighting device which uses a heat conductive fluid or gas to transfer heat generated by light-emitting elements such as LEDs in the lighting device when in use, and which lighting device allows for a longer lifetime of the light-emitting elements compared to LED light bulbs filled with a heat conductive fluid or gas such that the LEDs in the LED light bulb are arranged in an atmosphere of heat conductive fluid or gas.

To address at least one of this concern and other concerns, a lighting device in accordance with the independent claim is provided. Preferred embodiments are defined by the dependent claims.

According to a first aspect, there is provided a lighting device which comprises a first at least in part light-transmissive surface structure at least in part defining or delimiting a fluidly sealed, closed first space. The first space includes a thermally conductive fluid therein. The lighting device comprises at least one second at least in part light-transmissive surface structure, which at least in part defines or delimits at least one second space which is fluidly connected to the exterior of the lighting device. The at least one second surface structure is partly enclosed by the first surface structure. The at least one second surface structure comprises a thermally conductive interface between the second space and the first space. The thermally conductive interface is coupled to at least one light-emitting element which is arranged within the second space and configured to emit light such that at least a portion of the emitted light passes through the at least one second surface structure, and subsequently through the first surface structure.

The first space and/or the second space may for example include or be constituted by one or more open voids or cavities.

The first surface structure and/or the at least one second surface structure may for example be transparent or translucent, or may include at least one portion that is transparent and at least one portion that is translucent.

By means of the thermally conductive interface between the second space and the first space, heat which for example may be generated by the at least one light-emitting element when in use can be transferred to the thermally conductive fluid included in the first space. By means of the thermally conductive fluid included in the first space, the heat can then be transported further away from the at least one light-emitting element. According to one or more embodiments of the present invention, the first surface structure may for example comprise an outer light-transmissive enclosure or dome, which defines an interface between the first space and the exterior of the lighting device. The heat can then be transported away from the at least one light-emitting element by means of the thermally conductive fluid included in the first space to the outer light-transmissive enclosure or dome, where the heat can be dissipated to the surroundings or exterior of the lighting device.

Since the thermally conductive fluid, which according to one or more embodiments of the present invention for example may include a gas including helium and/or hydrogen, is within a fluidly sealed, closed space, the at least one light-emitting element may have no or only little exposure to the thermally conductive fluid. Since light-emitting elements such as LEDs may age relatively rapidly when exposed to a thermally conductive fluid such as a helium-containing gas, the lifetime of the at least one light-emitting element in the lighting device according to the first aspect may be increased, as compared to if it would be arranged so as to be continually exposed to the thermally conductive fluid. Thereby, light emission functionality and/or capacity of the at least one light-emitting element may be maintained over a relatively long period of time, as compared to if the at least one light-emitting element would be arranged so as to be continually exposed to the thermally conductive fluid.

In the context of the present application, by a fluidly sealed space it is meant a space which is sealed against its surroundings so as to be able to maintain a fluid therein over a substantial period of time (e.g. as compared to the lifetime of the lighting device), substantially without exchange of fluid between the space and its surroundings. Preferably the space is sealed against its surroundings so that no, or only very little, exchange of fluid between the space and its surroundings may occur. Means for providing such a fluidly sealed space are as such known in the art.

The at least one second space, which is at least in part defined or delimited by the second surface structure, is fluidly connected to the exterior of the lighting device. The at least one second space may for example be fluidly connected to the exterior of the lighting device by means of an open end or opening. Thereby, the at least one light-emitting element which is arranged within the second space may be in contact with a fluid in the surroundings of the lighting device, e.g. a gas such as air.

The second space may be fluidly connected to the exterior of the lighting device by means of at least two ports. In the context of the present application, by a port it is meant an inlet or outlet, e.g. an opening, for intake or exhaust of fluid (to or from the second space).

According to one or more embodiments of the present invention, at least a portion of the second space may extend substantially along a longitudinal axis of the lighting device. According to an example, substantially the entire second space may extend substantially along a longitudinal axis of the lighting device. The longitudinal axis may for example be an axis of rotational symmetry of the lighting device.

According to one or more embodiments of the present invention, the lighting device may comprise at least two separately arranged second at least in part light-transmissive surface structures at least in part delimiting at least two separately arranged second spaces. Each of the second surface structures may be partly enclosed by the first surface structure. Each of the second spaces may be fluidly connected to the exterior of the lighting device. One of the second spaces may substantially in its entirety extend substantially along the longitudinal axis of the lighting device.

The first surface structure may for example comprise or be constituted by an outer light-transmissive enclosure defining an interface between the first space and the exterior of the lighting device.

The first surface structure and/or the outer light-transmissive enclosure may include a light-transmissive material which may be transparent or translucent, or may include at least one portion that is transparent and at least one portion that is translucent.

The first surface structure and/or the outer light-transmissive enclosure may for example be made of, at least in part, glass, for example fused silica glass (vitreous silica glass), soda-lime-silica glass (window glass), sodium borosilicate glass (pyrex), lead-oxide glass (crystal glass), aluminosilicate glass, or oxide glass. In alternative or in addition, the first surface structure and/or the outer light-transmissive enclosure may be made of, at least in part, sapphire and/or or transparent or translucent ceramic.

The first surface structure and/or the outer light-transmissive enclosure may in principle have any shape. According to examples, the first surface structure and/or the outer light-transmissive enclosure may be bulb-shaped or tube-shaped.

The first surface structure may comprise at least one light-scattering element configured to scatter light incident on the at least one light-scattering element. By means of the at least one light-scattering element, light output from the lighting device may become more homogeneous. Light-scattering effects may be desired for aesthetical purposes (e.g. so as to provide a sparkling effect to a viewer).

The at least one second surface structure may for example comprises an inner light-transmissive enclosure defining an interface between the at least one second space and the first space.

The at least one second surface structure and/or the inner light-transmissive enclosure may include a light-transmissive material which may be transparent or translucent, or may include at least one portion that is transparent and at least one portion that is translucent.

The at least one second surface structure and/or the inner light-transmissive enclosure may for example be made of, at least in part, glass, for example fused silica glass (vitreous silica glass), soda-lime-silica glass (window glass), sodium borosilicate glass (pyrex), lead-oxide glass (crystal glass), aluminosilicate glass, or oxide glass. In alternative or in addition, the at least one second surface structure and/or the inner light-transmissive enclosure may be made of, at least in part, sapphire and/or transparent or translucent ceramic, or comprise a ceramic part or portion such as a ceramic ring.

The at least one second surface structure and/or the inner light-transmissive enclosure may in principle have any shape. According to examples, the at least one second surface structure and/or the inner light-transmissive enclosure may be bulb-shaped or tube-shaped.

The at least one second surface structure may comprise at least one light-scattering element configured to scatter light incident on the at least one light-scattering element. For example, the at least one light-scattering element may comprise light-scattering particles embedded or integrated in the at least one second surface structure. In alternative or in addition, the at least one light-scattering element may comprise a layer or coating of material such as $Al_2O_3$, $BaSO_4$ and/or $TiO_2$ on an inner and/or outer surface of the at least one second surface structure, and/or an inner and/or outer surface of the at least one second surface structure may have a rough structure.

In alternative or in addition, the at least one second surface structure may comprises at least one wavelength-converting element configured to change wavelength of light incident on the at least one wavelength-converting element. For example, the at least one wavelength-converting element may comprise a layer or coating of phosphor on an inner and/or outer surface of the at least one second surface structure, or a layer or coating of another wavelength-converting material, e.g. luminescent material selected from one or more elements in the group of quantum confinement structures, lanthanide complexes, rare earth metal elements and phosphors, on an inner and/or outer surface of the at least one second surface structure.

As mentioned in the foregoing, the thermally conductive fluid in the first space may for example include a gas including helium and/or hydrogen. However, other types of thermally conductive fluids are contemplated.

The thermally conductive interface between the second space and the first space may for example comprise at least one carrier configured to support the at least one light-emitting element. The carrier may for example comprise at least one printed circuit board (PCB) and/or a foil. The carrier may be at least in part flexible (i.e. at least a portion or portions of the carrier may be flexible). For example, the carrier may include a flexible PCB and/or a flexible foil. The carrier may be configured to transfer heat, generated by the at least one light-emitting element when in use, away from the at least one light-emitting element. Thus the carrier may be configured so as to exhibit a heat transferring capacity and/or functionality.

According to one or more embodiments of the present invention, the lighting device may comprise a fluid passage which is in fluid communication with the first space. The fluid passage may include a fluid inlet configured to selectively fluidly connect the first space with a source of thermally conductive fluid, for conveying thermally conductive fluid from the source into the first space. The fluid inlet may for example comprise a valve. A fluid passage including a fluid inlet port configured to selectively fluidly connect the first space with a source of thermally conductive fluid allows for the first space to be (re-)filled with thermally conductive fluid from the source of thermally conductive fluid.

The at least one light-emitting element may for example include or be constituted by a solid state light emitter. Examples of solid state light emitters include LEDs, OLEDs, and laser diodes. Solid state light emitters are relatively cost efficient light sources since they in general are relatively inexpensive and have a relatively high optical efficiency and a relatively long lifetime. However, in the context of the present application, the term "light-emitting element" should be understood to mean substantially any device or element that is capable of emitting radiation in any region or combination of regions of the electromagnetic spectrum, for example the visible region, the infrared region, and/or the ultraviolet region, when activated e.g. by applying a potential difference across it or passing a current through it. Therefore a light-emitting element can have monochromatic, quasi-monochromatic, polychromatic or broadband spectral emission characteristics. Examples of light-emitting elements include semiconductor, organic, or polymer/polymeric LEDs, violet LEDs, blue LEDs, optically pumped phosphor coated LEDs, optically pumped nano-crystal LEDs or any other similar devices as would be readily understood by a person skilled in the art. Furthermore, the term light-emitting element can, according to one or more embodiments of the present invention, mean a combination of the specific light-emitting element or light-emitting elements which emit the radiation in combination with a housing or package within which the specific light-emitting element or light-emitting elements are positioned or arranged. For example, the term light-emitting element can encompass a bare LED die arranged in a housing, which may be referred to as a LED package.

Further objects and advantages of the present invention are described in the following by means of exemplifying embodiments. It is noted that the present invention relates to all possible combinations of features recited in the claims. Further features of, and advantages with, the present invention will become apparent when studying the appended claims and the description herein. Those skilled in the art realize that different features of the present invention can be combined to create embodiments other than those described herein.

BRIEF DESCRIPTION OF THE DRAWINGS

Exemplifying embodiments of the invention will be described below with reference to the accompanying drawings.

Figure 1:
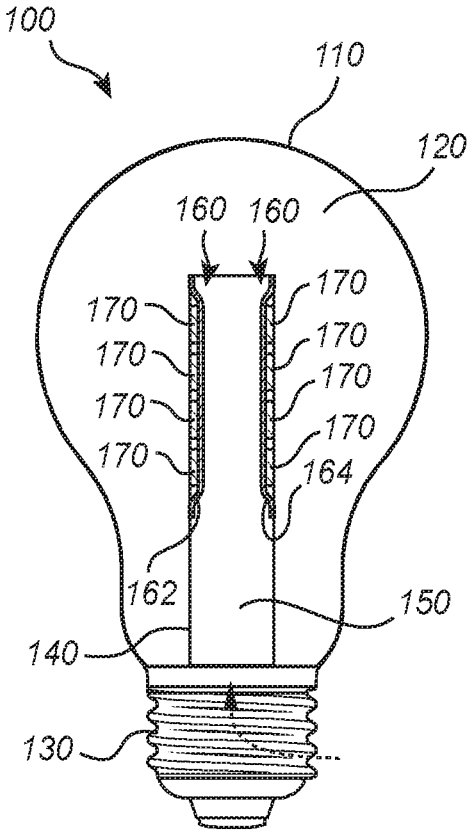
FIGS. 1 to 7 are schematic cross-sectional side views of lighting devices according to embodiments of the present invention.

All the figures are schematic, not necessarily to scale, and generally only show parts which are necessary in order to elucidate embodiments of the present invention, wherein other parts may be omitted or merely suggested.

DETAILED DESCRIPTION

The present invention will now be described hereinafter with reference to the accompanying drawings, in which exemplifying embodiments of the present invention are shown. The present invention may, however, be embodied in many different forms and should not be construed as limited to the embodiments set forth herein; rather, these embodiments are provided by way of example so that this disclosure will convey the scope of the invention to those skilled in the art.

In the drawings, identical reference numerals denote the same or similar components having a same or similar function, unless specifically stated otherwise.

FIG. 1 is a schematic cross-sectional side view of a lighting device 100 according to an embodiment of the present invention.

The lighting device 100 comprises a first at least in part light-transmissive surface structure 110 which in part delimits a fluidly sealed, closed first space 120, which first space 120 includes a thermally conductive fluid within the first space 120. According to the embodiment of the present invention illustrated in FIG. 1, the first surface structure 110 comprises an outer light-transmissive enclosure having a bulb-shape. Other shapes of the first surface structure 110 and/or the outer light-transmissive enclosure are possible.

The thermally conductive fluid included within the first space 120 may for example include a gas including helium and/or hydrogen.

Further in accordance with the embodiment of the present invention illustrated in FIG. 1, the lighting device 100 may comprise a base 130 for connection to a lamp or luminaire socket (not shown in FIG. 1). The base 130 may include or be constituted by any suitable type of coupler or connector, for example an Edison screw base, a bayonet fitting, or any other type of connection which may be suitable for the particular type of lamp or luminaire.

The lighting device 100 comprises a second at least in part light-transmissive surface structure 140 which in part defines a second space 150, which second space 150 is fluidly connected to the exterior of the lighting device 100. The second space 150 may for example be fluidly connected to the exterior of the lighting device 100 by means of an open end or opening (not shown in FIG. 1), which for example may be situated in the base 130, as indicated by the arrow in FIG. 1. In alternative or in addition, the second space 150 may be fluidly connected to the exterior of the lighting device 100 by means of one or more ports or openings (not shown in FIG. 1) for intake or exhaust of fluid to or from the second space 150. Such ports or openings may for example be arranged or situated in the base 130, or in some other appropriate portion or part of the lighting device 100.

According to the embodiment of the present invention illustrated in FIG. 1, the second surface structure 140 comprises an inner light-transmissive enclosure having a tubular shape. Other shapes of the second surface structure 140 and/or the inner light-transmissive enclosure are however possible.

The second surface structure 140 comprises a thermally conductive interface 160 between the second space 150 and the first space 120. The thermally conductive interface 160 is coupled to light-emitting elements 170 arranged within the second space 150 and configured to emit light, such that at least a portion of the light that is emitted by the respective light-emitting elements 170 passes through the second surface structure 140. Subsequently, the light may pass through the first surface structure 110. According to the embodiment of the present invention illustrated in FIG. 1, the thermally conductive interface 160 comprises two carriers 162, 164 to which the light-emitting elements 170 are coupled or connected. Further in accordance with the embodiment of the present invention illustrated in FIG. 1, the thermally conductive interface 160 includes the two carriers 162, 164 and the inner side of the portion of the second surface structure 140 or inner light-transmissive enclosure that is enclosed by the first surface structure 110 or outer light-transmissive enclosure, as illustrated in FIG. 1. As illustrated in FIG. 1, the light-emitting elements 170 may be connected or coupled to the inner side of the second surface structure 140 or inner light-transmissive enclosure, and also to (one of) the carriers 162, 164. The light-emitting elements 170 may for example be configured as a string of light-emitting elements, as indicated in FIG. 1, according to which the light-emitting elements 170 are configured as two strings of light-emitting elements. Although the light-emitting elements 170 according to the embodiment of the present invention illustrated in FIG. 1 are configured as two strings of light-emitting elements, the light-emitting elements 170 could for example be configured as a single string of light-emitting elements (cf., e.g., FIG. 2).

Each of the carriers 162, 164 may for example comprise a PCB and/or a foil, e.g. a flexible PCB or a so called flexfoil. Each of the carriers 162, 164 may be configured to transfer heat, generated for example by the light-emitting elements 170 when in use, away from the light-emitting elements 170, and may hence be configured so as to exhibit a heat transferring capacity and/or functionality.

The light-emitting elements 170 may for example be configured as a strip or string of light-emitting elements 170. Any one of the light-emitting elements 170 may for example include or be constituted by a solid state light emitter, such as, but not limited to, an inorganic LED or an organic LED (OLED).

As indicated in FIG. 1 (and also in FIGS. 2 to 7, 10 and 11), the light-emitting elements 170 may for example be configured as one or more strings of light-emitting elements, which strings (or string) extend in a direction parallel or substantially parallel with a longitudinal axis (not indicated in FIG. 1—cf. FIG. 6) of the lighting device 100. It is to be understood that such a configuration of the light-emitting elements 170 is according to an example and that variations are possible. For example, the light-emitting elements 170 could in accordance with another example be configured as one or more strings of light-emitting elements which strings (or string) extend in a plane perpendicular or substantially perpendicular to a longitudinal axis of the lighting device 100. For example in case the second surface structure(s) 140 has/have a shape that is tubular, cylindrical, conical, etc., such that the second surface structure(s) 140 has/have a generally circular cross section along an axial direction, the light-emitting elements 170 could be configured as one or more ring-shaped strings of light-emitting elements, so as to emit light into a number of different directions.

As illustrated in FIG. 1, the first space 120 may hence be or include a space which is situated between an inner surface of the first surface structure 110 or outer light-transmissive enclosure and an outer surface of the second surface structure 140 or inner light-transmissive enclosure.

By way of the second space 150 being fluidly connected to the exterior of the lighting device 100, the light-emitting elements 170 arranged within the second space 150 may be in (possibly constant) contact with fluid in the surroundings of the lighting device 100, e.g. a gas such as air.

As known in the art, the lighting device 100 may include circuitry capable of converting electricity from a power supply to electricity suitable to operate or drive the light-emitting elements 170 and/or power any other electrical components that may be included in the lighting device 100. Such circuitry, which is not shown in FIG. 1, may be capable of at least converting between Alternating Current and Direct Current and converting voltage into a suitable voltage for operating or driving the light-emitting elements 170. Such circuitry may include electronics such as a driver, a controller and/or wiring for conveying electricity to the light-emitting elements 170, the wiring e.g. extending from the base 130 to the light-emitting elements 170.

FIGS. 2 to 7 are schematic cross-sectional side views of a lighting device 100 according to embodiments of the present invention, which are similar to the lighting device 100 illustrated in FIG. 1. Identical reference numerals in the drawings denote the same or similar components having a same or similar function, unless specifically stated otherwise. In FIGS. 2 to 7 the base 130 of the lighting device 100 illustrated in FIG. 1 is omitted. However, it is to be understood that any one of the lighting devices 100 illustrated in FIGS. 2 to 7 may include a base, similar to or the same as the base 130 described with reference to FIG. 1.

Figure 2:
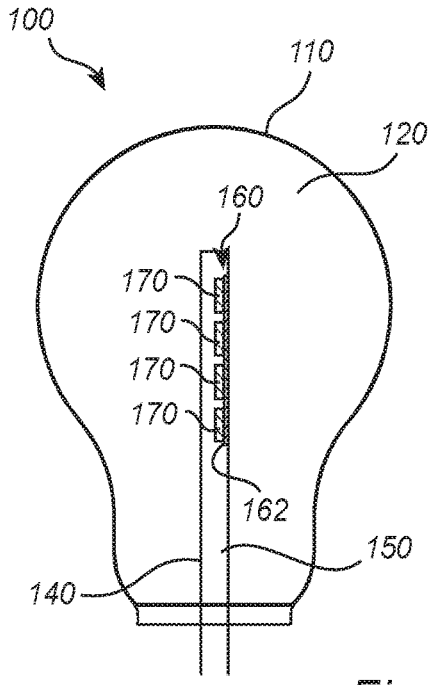

Referring now to FIG. 2, the thermally conductive interface 160 may comprise a carrier 162 configured to support the light-emitting elements 170. Compared to the lighting device 100 illustrated in FIG. 1, the light-emitting elements 170 are supported by (and/or possibly coupled or connected to) the carrier 162, and the carrier 162 is coupled or connected to the inner side of the second surface structure 140 or inner light-transmissive enclosure. Further, as already indicated above, the light-emitting elements 170 are, in contrast to in the lighting device 100 illustrated in FIG. 1, configured as a single string of light-emitting elements. In case the light-emitting elements 170 are configured as a single string of light-emitting elements, as indicated in FIG. 2, and which emit light substantially in one direction, for example the first surface structure 110 may be at least in part translucent, whereby (some) light incident on the first surface structure 110 may be reflected back into the first space 120 and subsequently exit the lighting device 100 at or via a different location on the first surface structure 110.

Figure 3:
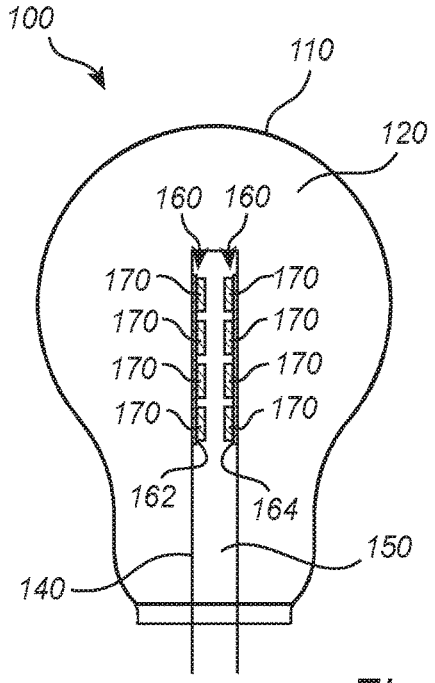

FIG. 3 illustrates a lighting device 100 similar to that illustrated in FIG. 2. Compared to the lighting device 100 illustrated in FIG. 2, the lighting device 100 illustrated in FIG. 3 comprises two carriers 162, 164 configured to support the light-emitting elements 170 (or to which the light-emitting elements 170 are coupled or connected), with the two carriers 162, 164 (and the respective light-emitting elements 170) being arranged opposite each other on the inner side of the tube-shaped second surface structure 140 or inner light-transmissive enclosure.

Figure 4:
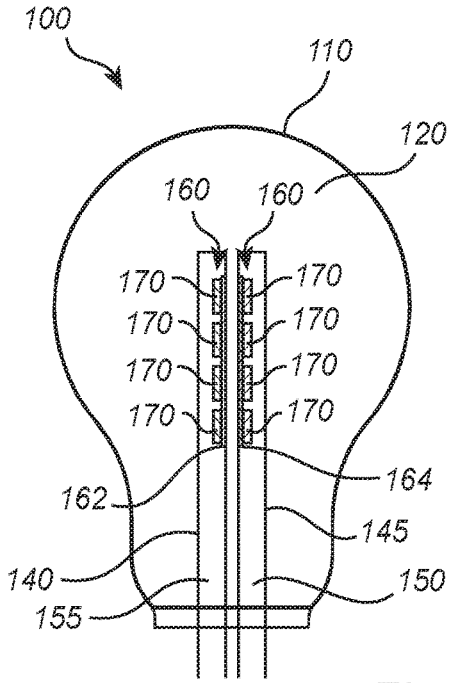

Referring now to FIG. 4, the lighting device 100 may comprise more than one second at least in part light-transmissive surface structure and more than one second space. Compared to the lighting devices 100 illustrated in FIGS. 1 to 3, the lighting device 100 illustrated in FIG. 4 comprises two separately arranged second at least in part light-transmissive surface structures 140, 145, which in part define two separately arranged second spaces 150, 155, respectively. Both of the second surface structures 140, 145 are partly enclosed by the first surface structure 110. Each of the second spaces 150, 155 is fluidly connected to the exterior of the lighting device 100. According to one or more embodiments of the present invention, there may however be more than two separately arranged second at least in part light-transmissive surface structures.

Figure 5:
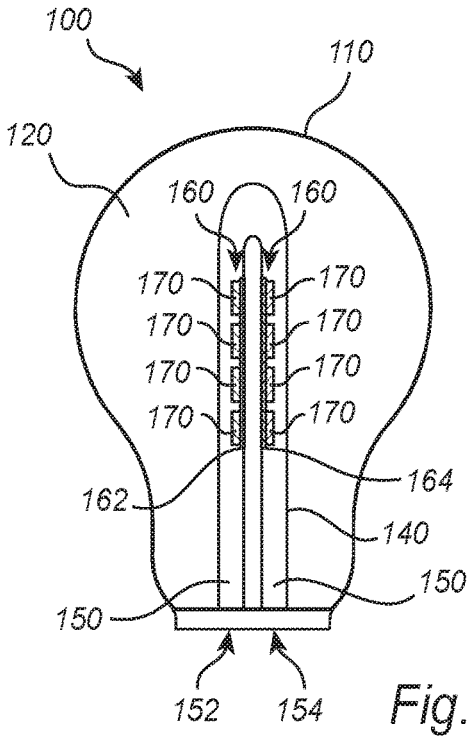

Referring now to FIG. 5, the second space 150 may be fluidly connected to the exterior of the lighting device 100 by means of more than one port or opening for intake or exhaust of fluid to or from the second space 150. For example, according to the embodiment of the present invention illustrated in FIG. 5, the second space 150 may be fluidly connected to the exterior of the lighting device 100 by means of two ports, generally indicated by reference numerals 152 and 154, respectively. The two ports 152, 154 realize inlet and outlet, e.g. by way of openings to the exterior of the lighting device 100, for intake or exhaust of fluid to or from the second space 150. According to one or more embodiments of the present invention, there may be more than two ports or openings for intake or exhaust of fluid to or from the second space 150.

Figure 6:
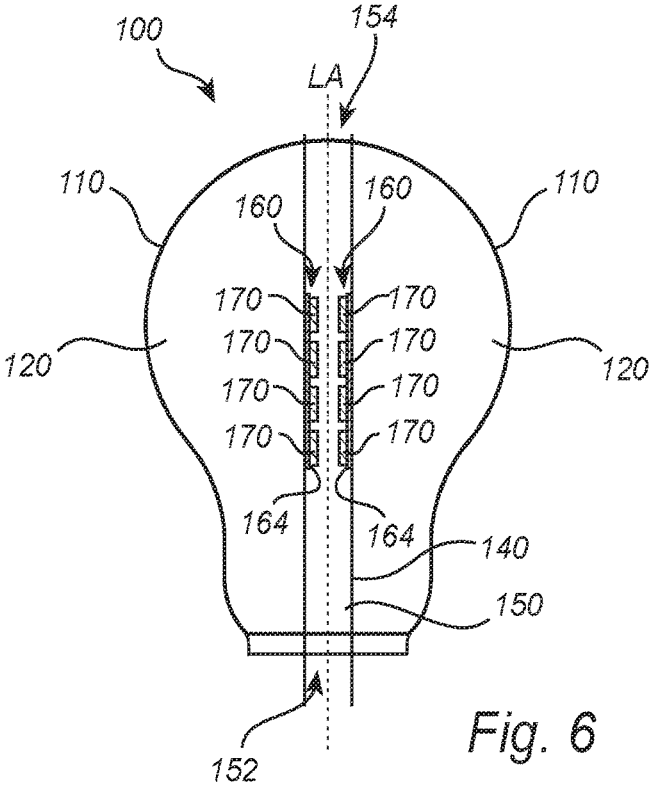

FIG. 6 illustrates a lighting device 100 according to an embodiment of the present invention, which similarly to the lighting device 100 illustrated in FIG. 5 has more than one port or opening for intake or exhaust of fluid to or from the second space 150, with two ports 152, 154. The port 154 is on top of the lighting device 100. According to the embodiment of the present invention illustrated in FIG. 6, the second surface structure 140 has a tubular shape, whereby the second space 150 also is tube-shaped, and at least a portion of the second space 150 extends along a longitudinal axis LA of the lighting device 100. As illustrated in FIG. 6, the second space 150 may extend substantially from top to bottom of the lighting device 100. Further according to the embodiment of the present invention illustrated in FIG. 6, the longitudinal axis LA may be an axis of rotational symmetry of the lighting device 100.

Figure 7:
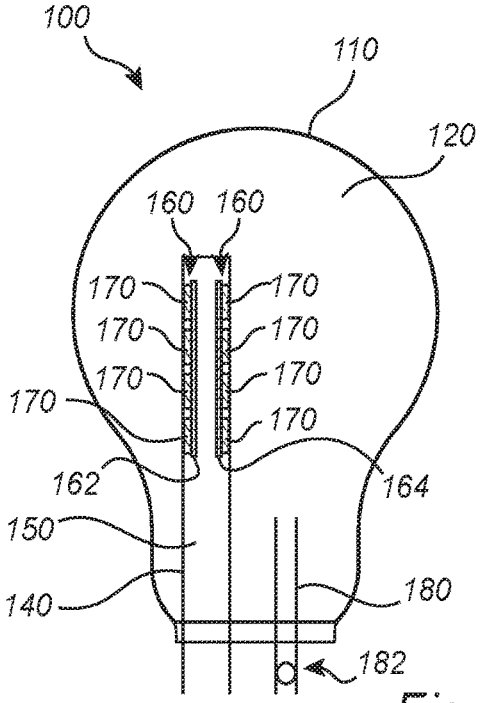

Referring now to FIG. 7, the lighting device 100 may comprise a fluid passage 180 in fluid communication with the first space 120. The fluid passage 180 includes a fluid inlet 182 (e.g., comprising a valve) configured to selectively fluidly connect the first space 120 with a source of thermally conductive fluid (not shown in FIG. 7). By way of the fluid passage 180 being in fluid communication with the first space 120 and the fluid inlet 182 the first space 120 may be (re-)filled with thermally conductive fluid from the source of thermally conductive fluid.

Figure 8:
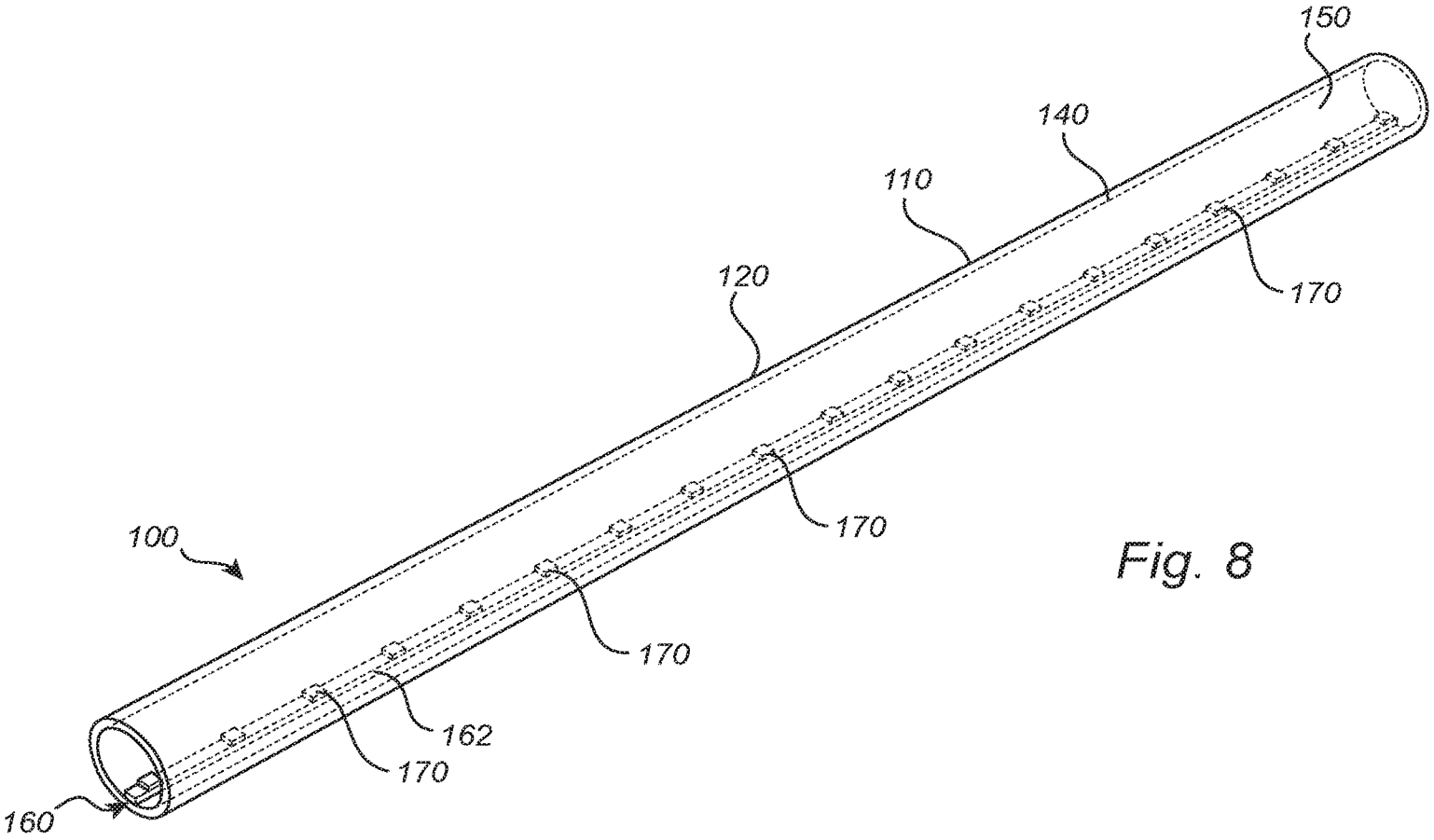
FIGS. 8 and 9 are schematic perspective views of lighting devices according to embodiments of the present invention.
Figure 9:
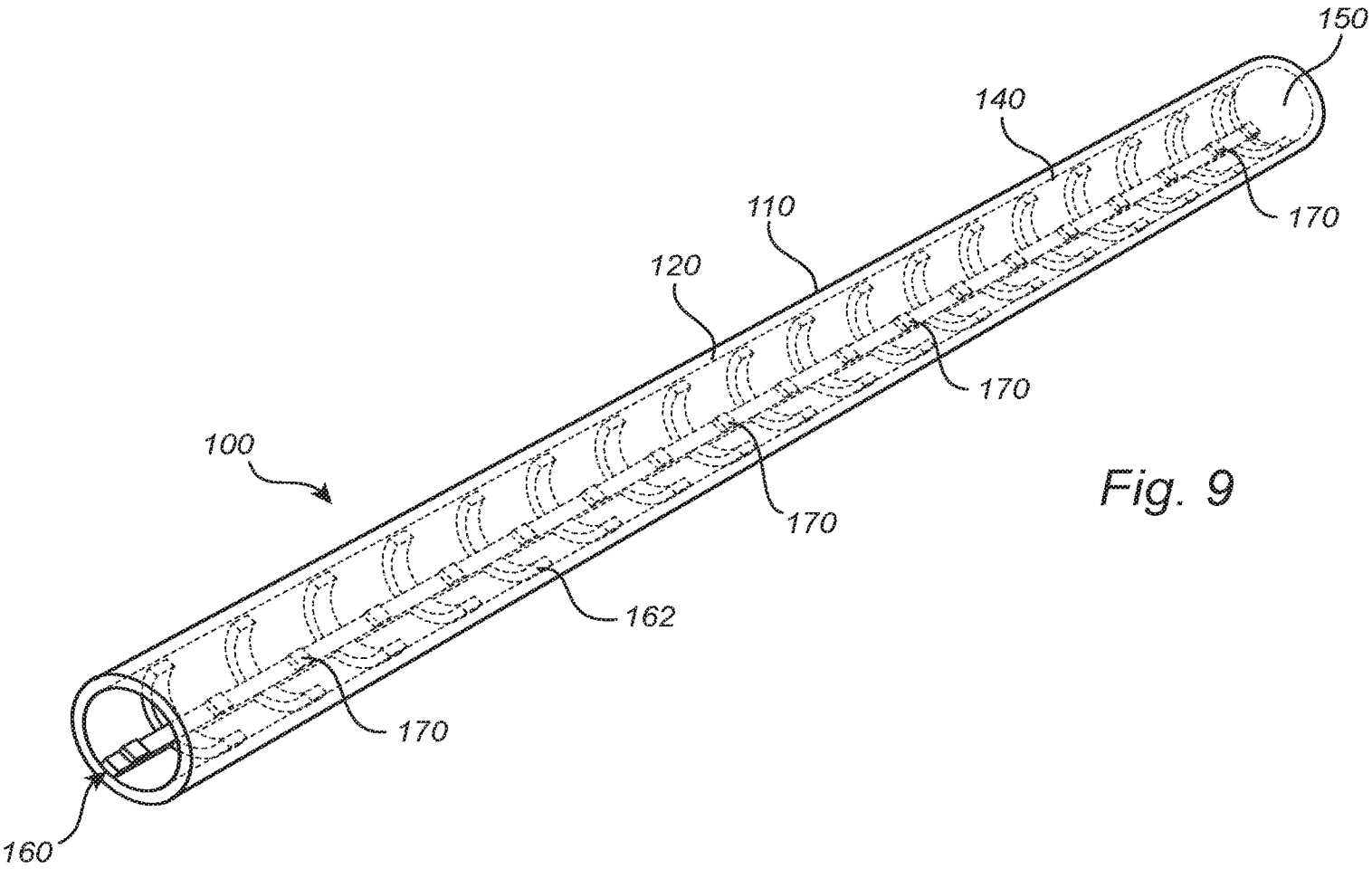

While the lighting devices 100 illustrated in FIGS. 1 to 7 are bulb-shaped, by including a first surface structure 110 having a bulb-shape, other shapes of the first surface structure 110 and/or the outer light-transmissive enclosure are possible. Reference is made to FIGS. 8 and 9, which each illustrates a portion of a lighting device 100 in accordance with an embodiment of the present invention. According to the embodiments of the present invention illustrated in FIGS. 8 and 9, the first surface structure 110 comprises an outer light-transmissive enclosure (of which only a portion is shown in FIGS. 8 and 9) which is tube-shaped. Further according to the embodiments of the present invention illustrated in FIGS. 8 and 9, also the second surface structure 140 and/or the inner light-transmissive enclosure are tube-shaped.

With further reference to FIGS. 8 and 9, the first surface structure 110 comprises an outer light-transmissive enclosure and in part delimits a fluidly sealed, closed first space 120, which first space 120 includes a thermally conductive fluid within the first space 120. The second surface structure 140 comprises an inner light-transmissive enclosure (of which only a portion is shown in FIGS. 8 and 9) and in part defines a second space 150, which second space 150 is fluidly connected to the exterior of the lighting device 100.

According to the embodiments of the present invention illustrated in FIGS. 8 and 9, the lighting device 100 comprises a thermally conductive interface 160 that comprises a carrier 162 configured to support the light-emitting elements 170. Only some of the light-emitting elements 170 are indicated by reference numerals in FIGS. 8 and 9.

As indicated in FIG. 9, the carrier 162 may be configured so as to provide a relatively large thermal contact region between the carrier 162 and the inner side or inner surface of the second surface structure 140 or inner light-transmissive enclosure.

Figure 10:
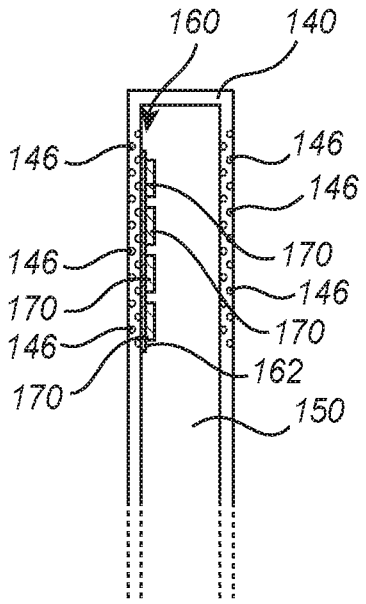
FIGS. 10 and 11 are schematic cross-sectional side views of second surface structures in accordance with embodiments of the present invention.
Figure 11:
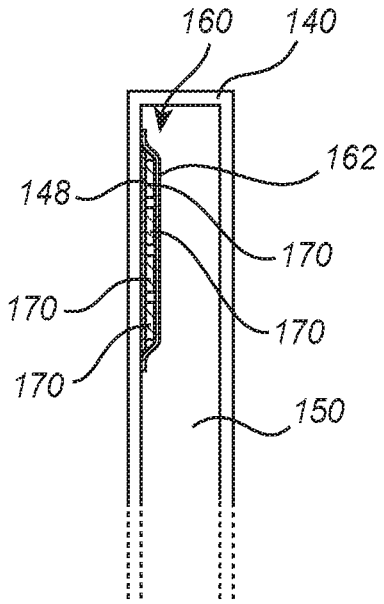

Referring now to FIGS. 10 and 11, there are shown schematic cross-sectional side views of (portions of) second surface structures 140 in accordance with embodiments of the present invention. Each of the second surface structures 140 illustrated in FIGS. 10 and 11 may be used in conjunction with any one of the other embodiments of the present invention described herein.

As illustrated in FIG. 10, the second surface structure 140 may comprise one or more light-scattering elements or particles 146 configured to scatter light incident thereon. The light-scattering elements or particles 146 may be such as are known in the art. Only some of the light-scattering elements or particles 146 are indicated by a reference numeral in FIG. 10. The light-scattering elements 146 may be embedded or integrated in the second surface structure 140, such as illustrated in FIG. 10.

As illustrated in FIG. 11, the second surface structure 140 may comprise a wavelength-converting element 148 configured to change wavelength of light incident thereon. According to the embodiments of the present invention illustrated in FIG. 11, the wavelength-converting element 148 comprises a layer or coating of wavelength-converting material on an inner side of the second surface structure 140. In alternative or in addition, there may be a layer or coating of wavelength-converting material on an outer side of the second surface structure 140. The wavelength-converting material may for example include a phosphor or luminescent material selected from one or more elements in the group of quantum confinement structures, lanthanide complexes, and rare earth metal elements.

In conclusion, a lighting device is disclosed, comprising a first closed or delimited space which is fluidly sealed and includes a thermally conductive fluid therein, and at least one delimited second space which is partly enclosed by the first space and is fluidly connected to the exterior of the lighting device. The second space comprises a thermally conductive interface to the first space. The thermally conductive interface is coupled to at least one light-emitting element arranged within the second space and configured to emit light such that at least a portion of the emitted light is emitted into the first space.

While the present invention has been illustrated in the appended drawings and the foregoing description, such illustration is to be considered illustrative or exemplifying and not restrictive; the present invention is not limited to the disclosed embodiments. Other variations to the disclosed embodiments can be understood and effected by those skilled in the art in practicing the claimed invention, from a study of the drawings, the disclosure, and the appended claims. In the appended claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A lighting device comprising:

a base for connection to a socket;

a first at least in part light-transmissive surface structure at least in part delimiting a fluidly sealed, closed first space which includes a thermally conductive fluid therein, wherein the first light-transmissive surface structure is mounted to the base; and at least one second at least in part light-transmissive surface structure at least in part defining at least one second space which is fluidly connected to the exterior of the lighting device through the base, which at least one second surface structure is contained entirely within the first surface structure and the base;

wherein the at least one second surface structure has a closed first end and a second, opposite end adjacent the base that fluidly couples the second space to the exterior of the lighting device through the base;

wherein the at least one second surface structure comprises a thermally conductive interface between the second space and the first space, the thermally conductive interface being coupled to at least one light-emitting element arranged within the second space and configured to emit light such that at least a portion of the emitted light passes through the at least one second surface structure and subsequently through the first surface structure; and wherein the at least one light-emitting element arranged within the second space is in contact with fluid surrounding the lighting device.

2. A lighting device according to claim 1, wherein the second space is fluidly connected to the exterior of the lighting device by means of at least two ports through the base.

3. A lighting device according to claim 2, wherein at least a portion of the second space extends substantially along a longitudinal axis of the lighting device.

4. A lighting device according to claim 3, wherein the longitudinal axis is an axis of rotational symmetry of the lighting device.

5. A lighting device according to claim 1, comprising at least two separately arranged second at least in part light-transmissive surface structures at least in part delimiting at least two separately arranged second spaces, each of which second surface structures is partly enclosed by the first surface structure, wherein each of the second spaces is fluidly connected to the exterior of the lighting device through the base.

6. A lighting device according to claim 1, wherein the first surface structure comprises an outer light-transmissive enclosure defining an interface between the first space and the exterior of the lighting device.

7. A lighting device according to claim 6, wherein the first surface structure comprises at least one light-scattering element configured to scatter light incident thereon.

8. A lighting device according to claim 1, wherein the first surface structure is bulb-shaped or tube-shaped.

9. A lighting device according to claim 1, wherein the at least one second surface structure comprises an inner light-transmissive enclosure defining an interface between the at least one second space and the first space.

10. A lighting device according to claim 1, wherein the at least one second surface structure is bulb-shaped or tube-shaped.

11. A lighting device according to claim 1, wherein the at least one second surface structure comprises at least one light-scattering element configured to scatter light incident thereon.

12. A lighting device according to claim 1, wherein the at least one second surface structure comprises at least one wavelength-converting element configured to change wavelength of light incident thereon.

13. A lighting device according to claim 1, wherein the thermally conductive fluid in the first space comprises a gas including helium and/or hydrogen.

14. A lighting device according to claim 1, wherein the thermally conductive interface comprises at least one carrier configured to support the at least one light-emitting element.

15. A lighting device according to claim 1, further comprising:

a fluid passage in fluid communication with the first space, the fluid passage including a fluid inlet configured to selectively fluidly connect the first space with a source of thermally conductive fluid.

16. The lighting device of claim 1, wherein the at least one second space is fluidly connected to the exterior of the lighting device by way of one or more ports that are exclusively disposed in the base.

17. A method comprising:

providing a base for connection to a socket; and mounting, to the base, a first at least in part light-transmissive surface structure at least in part delimiting a fluidly sealed, closed first space which includes a thermally conductive fluid therein;

wherein as a consequence of the mounting, at least one second at least in part light-transmissive surface structure is contained entirely within the first surface structure and the base, the second transmissive surface structure defining at least one second space which is fluidly connected to the exterior of the lighting device through the base, wherein the at least one second surface structure comprises a thermally conductive interface between the second space and the first space, the thermally conductive interface being coupled to at least one light-emitting element arranged within the second space and configured to emit light such that at least a portion of the emitted light passes through the at least one second surface structure and subsequently through the first surface structure;

wherein the at least one second surface structure has a closed first end and a second, opposite end adjacent the base that fluidly couples the second space to the exterior of the lighting device through the base; and wherein the at least one light-emitting element arranged within the second space is in contact with fluid surrounding the lighting device.

* * * * *